US006450838B2

(12) United States Patent
Arnett

(10) Patent No.: US 6,450,838 B2
(45) Date of Patent: Sep. 17, 2002

(54) UNIVERSALLY CONFIGURABLE MODULAR CONNECTOR

(75) Inventor: Jamie Ray Arnett, Fishers, IN (US)

(73) Assignee: Avaya, Inc., Basking Ridge, NJ (US)

( * ) Notice: Subject to any disclaimer, the term of this patent is extended or adjusted under 35 U.S.C. 154(b) by 0 days.

(21) Appl. No.: 09/854,893

(22) Filed: May 14, 2001

Related U.S. Application Data

(63) Continuation-in-part of application No. 09/569,772, filed on May 12, 2000, now abandoned.

(51) Int. Cl.[7] ..... H01R 24/00
(52) U.S. Cl. ..... 439/676
(58) Field of Search ..... 439/676, 344, 439/941

(56) References Cited

U.S. PATENT DOCUMENTS 4,629,266 A 12/1986 Viselli ..... 339/17
5,700,167 A 12/1997 Pharney et al. ..... 439/676
5,885,110 A 3/1999 Ensz et al. ..... 439/676
6,012,936 A 1/2000 Siemon et al. ..... 439/188

*Primary Examiner*—P. Austin Bradley
*Assistant Examiner*—Ross Gushi
(74) *Attorney, Agent, or Firm*—Thomas, Kayden Horstemeyer & Risley , LLP

(57) ABSTRACT

A universal modular electrical connector for mounting on either a horizontally or vertically oriented printed wiring board or other circuit components; comprising a jack housing and a spring block. The spring block has at least one array of conductors extending therethrough from a nose end where the conductors extend in cantilever fashion from the block at an angle to form a planar array of spring contacts, to a connection end where the conductors extend from the block for connection to circuit a component or components. The spring block may have an additional second array of conductors extending therethrough in similar fashion to the first array and which is vertically spaced from the first array. At the connection end, each array of conductors is contained within its respective slots in the spring block. The slots are configured with a slanted surface which permits bending of the conductors of the array from, for example, a horizontal position to a vertical position. Thus, the same spring block can be easily configured for application or mounting to a variety of circuit component locations.

10 Claims, 6 Drawing Sheets

UNIVERSALLY CONFIGURABLE MODULAR CONNECTOR

CROSS-REFERENCE TO RELATED APPLICATION

This application is a continuation-in-part of U.S. utility application entitled, "Universal Modular Connector," having Ser. No. 09/569,772, filed May 12, 2000 now abandoned.

FIELD OF THE INVENTION

This invention relates to an electrical connector arrangement and, more particularly, to a modular connecting apparatus, such as is used as a component of communication equipment, and having substantially universal application by virtue of its configuration for use in either a vertical or horizontal orientation.

BACKGROUND OF THE INVENTION

Telecommunications and data transmission systems are increasingly being called upon to operate at higher and higher frequencies with tremendous growth in signaling traffic. Present day cables and wiring can, theoretically, handle such increased frequencies and traffic, but, as in the case of eight or twelve lead conductors, the proximity of such a number of wires can lead to degradation in performance of the connector and corresponding degradation of transmitted signals. For example, one problem inherent in increasing frequencies and conductor proximity is cross-talk. At frequencies above one megahertz (1 MHz), for example, the degradation of the signals can be, and most often is, unacceptable. Consequently, emphasis has been placed on designing connectors which themselves have, for example, conductor arrangements or configurations that minimize cross-talk within or produced by the connector. It has been found that connectors which comprise a jack and a dielectric spring block or plug can be configured to yield excellent performance with a minimum of cross-talk. Such an approach to improved performance requires, in most cases, specific redesigns or modifications of existing hardware and/or production of new hardware. Modifications or redesigns of existing hardware or the design and development of new hardware represent additional expenses, and result in a plethora of specialized plugs or jacks.

It has been found that the cross-talk coupling induced by the present-day standardized modular jack and plug can be reduced. Such a reduction involves the judicious placement of conductors after they exit the connector (jack and spring block or plug) so as to prompt cross-talk signals of opposite phase or polarity to those that are induced inside the connector.

A preferred way of inducing the cross-talk coupling is accomplished by having the conductors exit from the modular connector to a printed wiring board (PWB) thereby routing the conductors in a manner that produces a net reduction in cross-talk. Because of the flexibility for routing wiring inherent in PWB architecture, there are numerous printed circuit board arrangements that will reduce cross-talk, as well as achieve other transmission benefits.

In U.S. Pat. No. 5,700,167 to Pharney et al. there is shown one such arrangement wherein the leads extending from the rear of the spring block plug directly into contact holes in a vertically oriented PWB. The individual leads are thus connected to circuitry on the PWB that is routed to produce a net reduction in cross-talk. While the arrangement of the Pharney patent is directed primarily to a PWB that produces compensating cross-talk, such a PWB/connector configuration can be used in numerous other applications not necessarily directed to improvement in overall cross-talk performance.

In U.S. Pat. No. 5,885,110 to Ensz et al., it is shown to configure the passages extending through a spring block. Similarly, in U.S. Pat. No. 6,012,936 to Siemon et al., a switching jack is configured with passages situated therethrough and conductors that extend through the rear of the switching jack. Ostensibly, the configuration of the Siemon switching jack allows for a smaller sized, single opening jack that can be mounted to a circuit board in space-constrained applications. However, the Siemon jack cannot be selectively oriented for vertical or horizontal PWB orientations and requires separate connector configurations to accommodate PWB orientation.

As pointed out hereinbefore, the prior art contains numerous connector/PWB arrangements. In some of these arrangements the PWB is oriented in a plane that is normal to the centerline of the connector. In other arrangements the PWB is oriented in a plane that is parallel to the connector centerline. For each of these arrangements, the different orientation of the plane of the PWB relative to the connector centerline requires a specifically designed connector in those instances where the connector is, in effect, mounted directly on the PWB.

It is inconvenient and costly to maintain these specifically designed connectors. For instance, such specialized connectors require additional design resources, particular molds and tools (especially for injection molding of the plastic components), wire stamping and forming tools, and different electrical designs on the PWBs in order to meet the requirements to transmit data or other signals at growing performance levels. Further, a plurality of different specialty connectors places a burden on an assembler to stock and differentiate between many types of connectors during production, thus increasing inventory and expense.

Thus, a heretofore unaddressed need exists in the industry to address the aforementioned deficiencies and inadequacies.

SUMMARY OF THE INVENTION

The present invention comprises a universal modular connector having a dielectric spring block and a jack housing for receiving the spring block. The present connector is universal in that it is configured for use with either a horizontally oriented PWB or a vertically oriented PWB. Thus, only one set of parts, i.e. the spring block and jack, are necessary for use with a PWB of either horizontal or vertical orientation.

In a preferred embodiment of the present invention, the spring block has passages extending therethrough and a first and second array of parallel conductors. The first and second arrays of parallel conductors extend from the nose, or spring contact end, to the rear, or connection end, of the spring block. At the spring contact end of the spring block, the first and second arrays of conductors slope down and away therefrom in cantilever fashion to form a single planar array of spring contacts. The conductor arrays are vertically spaced from each other and the conductors in the first array are transversely offset from the conductors in the second array. Such a configuration makes it possible to separate the conductors from each other within the miniaturized spring block, and reduce, at least to some extent, the generation of cross-talk. It is anticipated that the passages may take the form of slots or bores extending through the block. It is further anticipated that the conductor configuration is applicable for the typical numbers of four, eight, ten or twelve conductors.

At the rear or end of the spring block are a plurality of slots communicating with the passages and extending upward from the lower one of the conductor arrays and along a portion of the top of the block. Thus, each of the conductors in the lower array, which normally extends beyond the rear of the block, can be bent such that the conductors extend from the top of the block at ninety degrees (90°) to accommodate a vertical orientation of the conductors as opposed to a horizontal orientation. The bending of the conductors to the correct degree for implementation in the vertical orientation is determined by a slanted surface configured into the slots or passages of the spring block. The slanted surface is at an angle Ø to the vertical (or 90° +Ø). Accordingly, when the conductors are bent to the vertical orientation, the slanted surface allows the conductor to be bent through 90° +Ø to insure that the conductor's natural resilience will cause it to stabilize at 90°.

In the horizontal orientation, the two arrays are vertically spaced such that there is a bottom and a top array. When the conductors are transformed from the horizontal orientation to the vertical orientation, the bottom array becomes the front array and the top array becomes the rear array. This is accomplished by the configuration of the first and second groups of passages extending from the spring block end to the connector end which accommodates the first and second, respectively, arrays of the conductors. However, in both the horizontal and the vertical orientations, the spacing of the conductors and the length of the conductors extending from the block is substantially the same or equivalent. Thus, universal application is made possible by the combined configuration of the lengths of the conductors, such that they extend the same distance from the block regardless of the orientation, and the first and second groups of passages. Accordingly, the spring block of the present invention provides consistent contacts regardless of whether it is configured for a vertical or a horizontal PWB application.

In usage, what is referred to as the top of the block is sometimes, when the block is inserted in the jack, the bottom, so that the conductors extend downward from the connector for insertion into contact holes within a horizontally oriented PWB. Thus, the terms "top" and "bottom", as viewed in the accompanying drawings for clarity of understanding, may be, when the connector is assembled, the bottom and the top respectively. Of course, there may be connector installations where the horizontal PWB lies above the connector or connectors. The conductors in the upper one of the conductor arrays can likewise be bent 90° to match the conductor configuration in the lower one of the arrays. In an embodiment of the invention, slots are provided in the block for these conductors also. The jack housing itself may also be slotted to accommodate the conductors in one or both of the arrays with the slots for the lowermost array being longer than the slots for the uppermost array.

Because the present invention can be used for vertical or horizontal PWB applications, it makes it possible to use a single modular connector design in a number of circuit configurations. The present invention requires only one set of parts or components, produces or insures common electrical performance, and the principles thereof can readily be applied to low cross-talk connectors. The assembler can readily make the necessary adjustments to the present invention in order easily conform it to a number of circuit configurations. Thus, the assembler is not required to stock large numbers of specialized connectors in its inventory, but instead can carry the configurable connector of the present invention.

In the detailed description hereinafter, the connector of the invention corresponds to a widely used connector design. However, there are a large number of connector designs in the prior art to which the principles and features of the present invention are readily adaptable. While the invention is described for use with either horizontal or vertically oriented PWBs, the principles of the invention are adaptable for use with other orientations as well.

DETAILED DESCRIPTION

Figure 1:
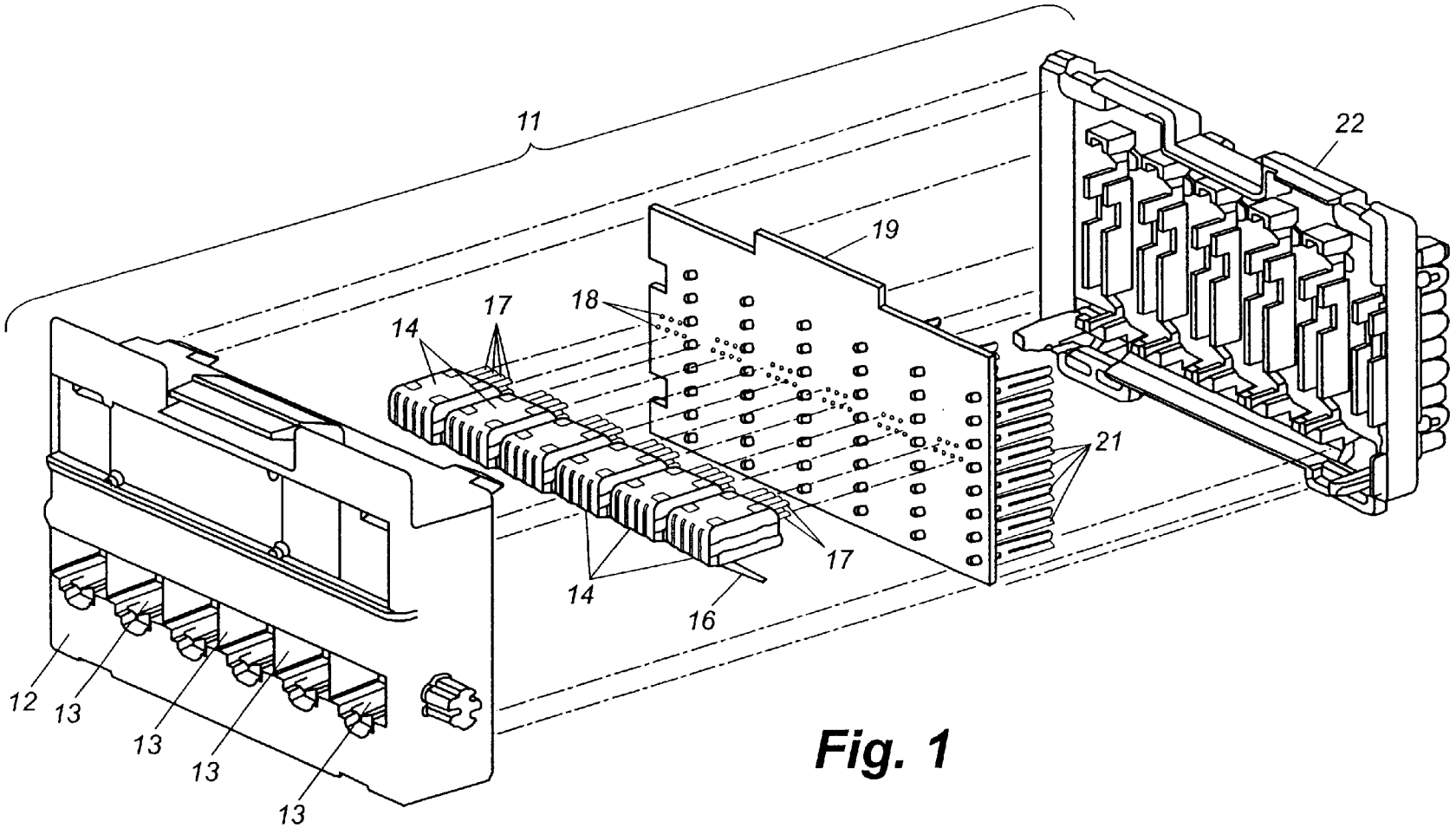
FIG. 1 is an exploded view, in perspective, of a prior art connector/PWB assembly as shown in the aforementioned Pharney et al. patent.

In FIG. 1 there is shown a prior art patch distribution module 11 as shown in the aforementioned Pharney et al. patent, and which comprises a front housing 12 having a plurality of apertures 13 for receiving standard modular plugs, not shown. Apertures 13 extend through housing member 12 and are adapted to receive, at the rear thereof, a plurality of spring blocks 14 which, when in place within the apertures 13, are connected to the modular plugs by means of a planar array 16 of angled conductors in a manner well known in the art. Spring blocks 14 have, in a standard configuration of four conductor pairs, eight conductor pins 17 protruding from the rear thereof in two spaced planar arrays of four pins each which are insertable into pin holes 18 in a vertically oriented PWB 19 for connection to the PWB circuitry. The circuitry of PWB 19 is connected by means of insulation displacement connectors 21 to associated circuitry as embodied in module 22. The combination of the apertured housing 12 and spring blocks 13 constitutes a plurality of connectors wherein each aperture 13 is the equivalent of an apertured jack frame, and the remainder of the detailed discussion deals with individual jack frames and accompanying dielectric spring blocks.

Figure 2:
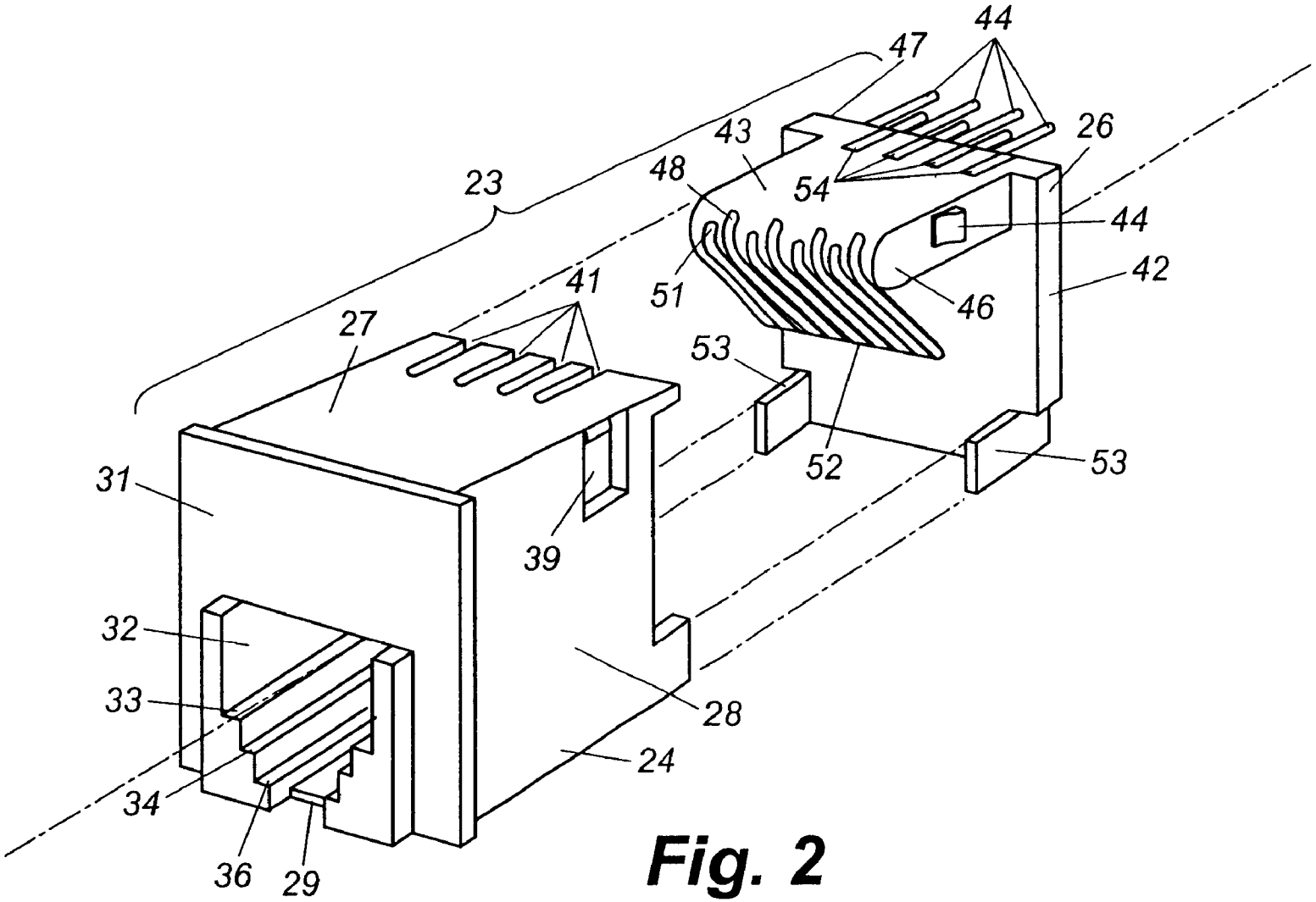
FIG. 2 is an exploded view, in perspective, of the spring block and jack frame or housing of the connector of the present invention as viewed from the front or spring contact end.

FIG. 2 is an exploded perspective view of a connector 23 that embodies the principals of the present invention. Connector 23 comprises a jack housing or frame 24 and a spring block 26, both of which are preferably made of dielectric material such as one of several plastic materials.

Figure 3:
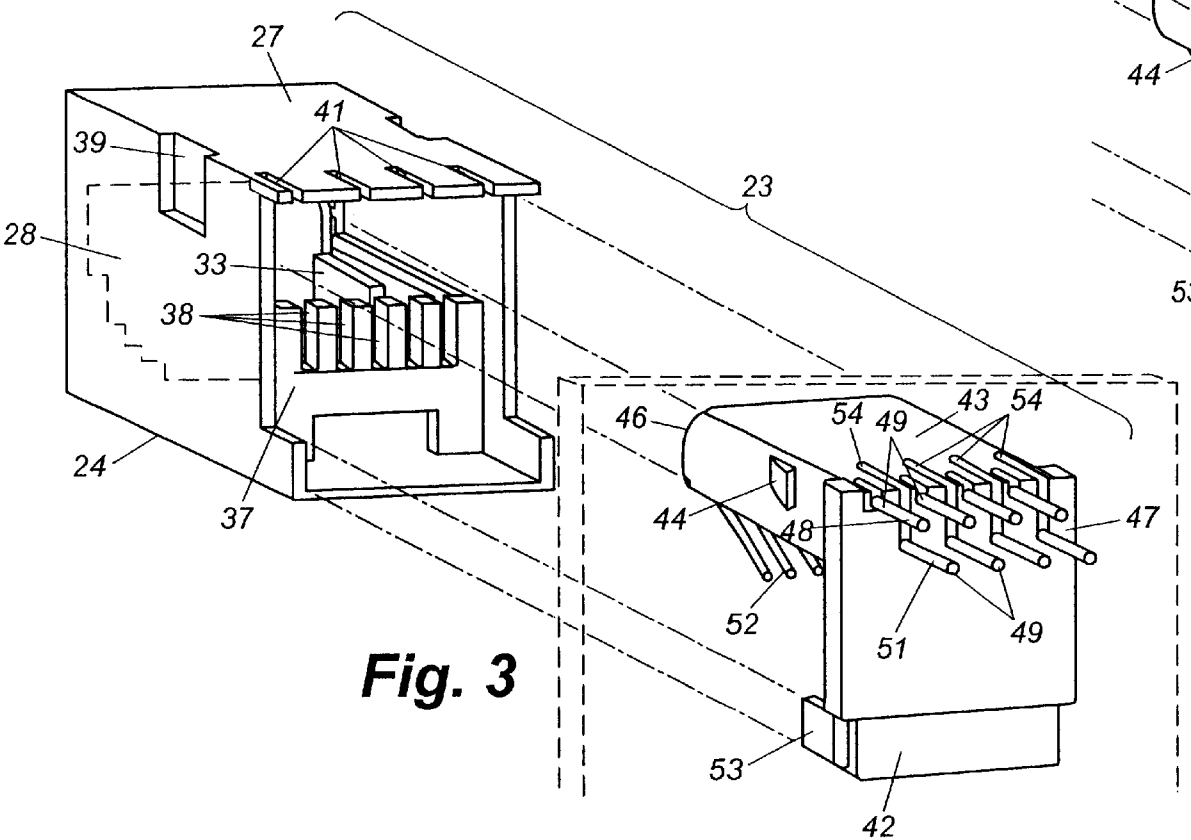
FIG. 3 is an exploded view, in perspective, of the spring block and jack of FIG. 2, as viewed from the rear or connection end with the conductors of the spring block extending from the block parallel to the axis thereof, for connection to a vertically oriented PWB.

Jack frame 24 comprises a substantially hollow body having a top wall or surface 27, depending side walls 28 and a bottom wall or surface 29. A front wall 31 has an aperture 32 therein which is configured to receive a connecting plug, not shown. The aperture configuration extends into the interior of housing 24 by means of shoulders 33, 34, and 36 to a vertical wall 37 which has a plurality of slots 38 extending from its top edge, as best seen in FIG. 3. Only five slots 38 are shown in FIG. 3 so that they do not appear too close together. However, there will be the same number of slots 38 as there are conducting leads in spring block 26, inasmuch as each slot 38 functions to hold a spring contact in position. Each of the side walls 28, only one of which is shown, has a latch opening 39 therein, for latching spring block 26 in place in the jack housing or frame 25. Along the rear edge of top wall 27 are a plurality of slots 41, the function of which will be discussed hereinafter.

For the particular type of connector 23 shown, spring block 26 has a rear wall 42 from the upper edge of which extends a body portion 43 having latching members 44 on either side thereof, which mate with openings 39 when body portion 43 is inserted into jack housing 24. When so inserted, wall 42 becomes the rear wall of the connector 23. Extending through body 43 from the nose or spring contact end 46 to the connection end 47 are an upper array 48 of conductors 49 and a lower array 51 of conductors 49 in passages within body 43. At nose end 46 the conductors 49 of the two arrays 48 and 51 depend at an angle from body 43 to form a planar array 52 of spring contacts. Each individual conductor 49 of the planar array 52 is, when block 26 is latched in place within housing 24, held in place by one of the slots 38 in wall 37.

Extending from the lower corners of wall 42 are locating tabs 53 which help align spring block 26 as it is inserted into housing 24. Along the top rear edge of spring block 26 and extending toward the front 46 thereof are a plurality of slots 54, the function of which will be discussed hereinafter.

In FIG. 3 the connector 23 is shown as viewed from the rear, and the arrangements of conductors 49, arrays 48 and 51, and slots 41 and 54 are depicted more clearly. It can be seen that the upper array 48 of conductors 49 and the lower array 51 are planar and extend into a vertically oriented PWB shown in dashed lines. The connections to the PWB may be as shown in FIG. 1, which echo the Pharney et al. patent disclosure. It will be noted that the slots 54 are not used in this configuration.

Figure 4:
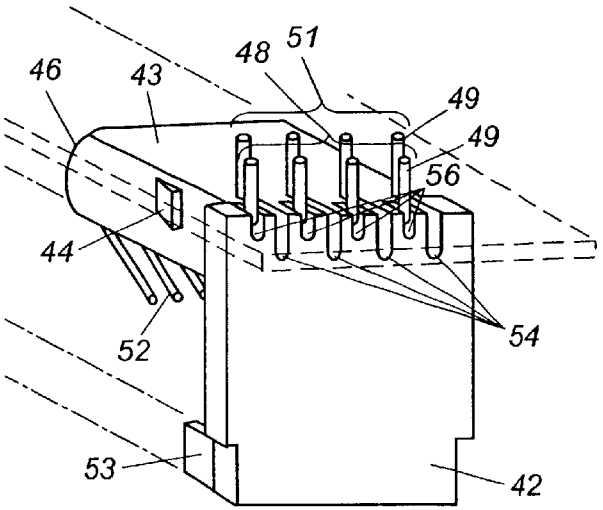
FIG. 4 is a perspective view of the spring block of FIG. 3; but with the conductors extending from the top of the block (or bottom), as the case may be, for connection to a horizontally oriented PWB.

In FIG. 4 the spring block 26 is shown as configured for connection to a horizontally oriented PWB shown in dashed lines, by bending the conductors 49 of both arrays 48 and 51 upward in the slots 54 at an angle of 90° to the centerline of the connector 23 to a substantially vertical orientation of the conductors. As shown, the conductors 49 of array 51 are bent upward in slots 54, while the conductors 49 of array 48 are bent upward in additional, shorter slots 56. In some connector configurations, slots 56 are not necessary provided the free length of conductors 49 in the array 48 is sufficient to insure fitting into the pin holes in the PWB. With the arrangement shown in FIG. 4, when spring block 26 is latched to housing 24, the conductors 49 in array 51 fit within the slots 41 in the top wall 27 of housing 27 which align with the slots 54. In other types of connectors (not shown), where the upper surface of body portion 43 of spring block 26 forms the top wall of the connector, the clearance afforded by slots 41 is not necessary, hence housing 24 has no such slots. In FIG. 4, array 51 fits within slots 54 and array 48 fits within slots 56. By transverse relocation of the slots, the conductors of array 48 can be made to fit within slots 54 and the conductors of array 51 can be made to fit within slots 56. Such a configuration is shown in FIGS. 5 and 6.

Figure 5:
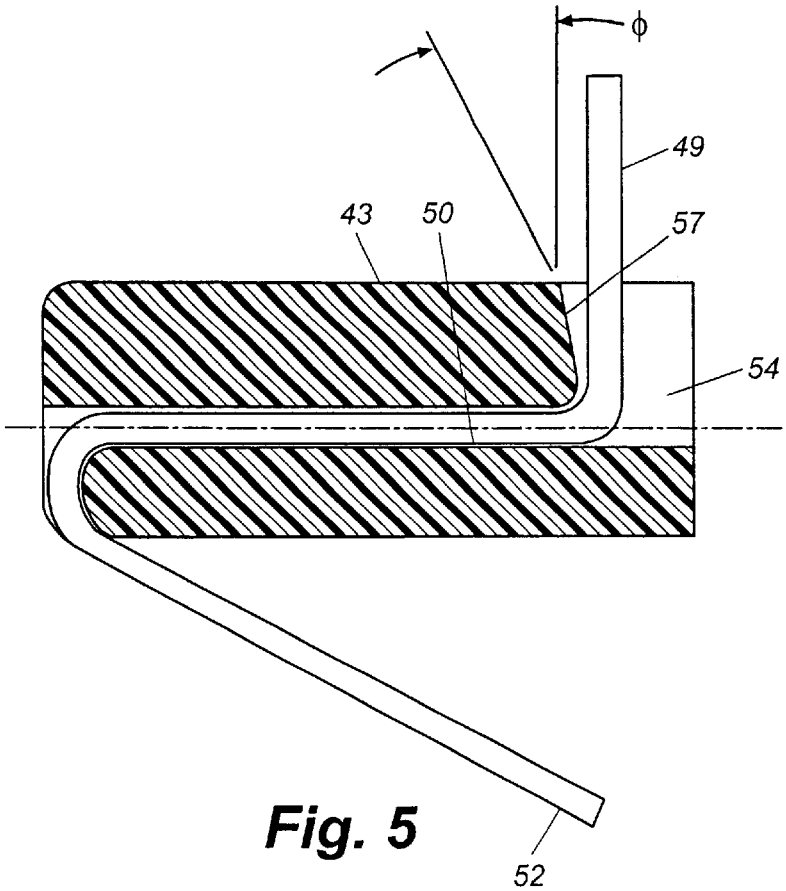
FIG. 5 is a cross-sectional diagrammatic elevation view of the spring block of the invention illustrating the routing through the block of the lower array of conductors.

FIG. 5 is a cross-sectional diagrammatic view of the configuration of slots 54 within the body portion 43, and the location of a conductor 49 of the lower array 51 which extends through bore 50, and is bent through 90° at the connection end. Slot 54 is preferably formed with a surface 57 which is at an angle Ø to the vertical (or 90° +Ø) to the horizontal. The angle Ø0 may be, for example, from 5° to 30°. This angled surface allows the conductor 49 to be bent through 90° +Ø to insure that its natural resilience will cause it to stabilize at 90°.

Figure 6:
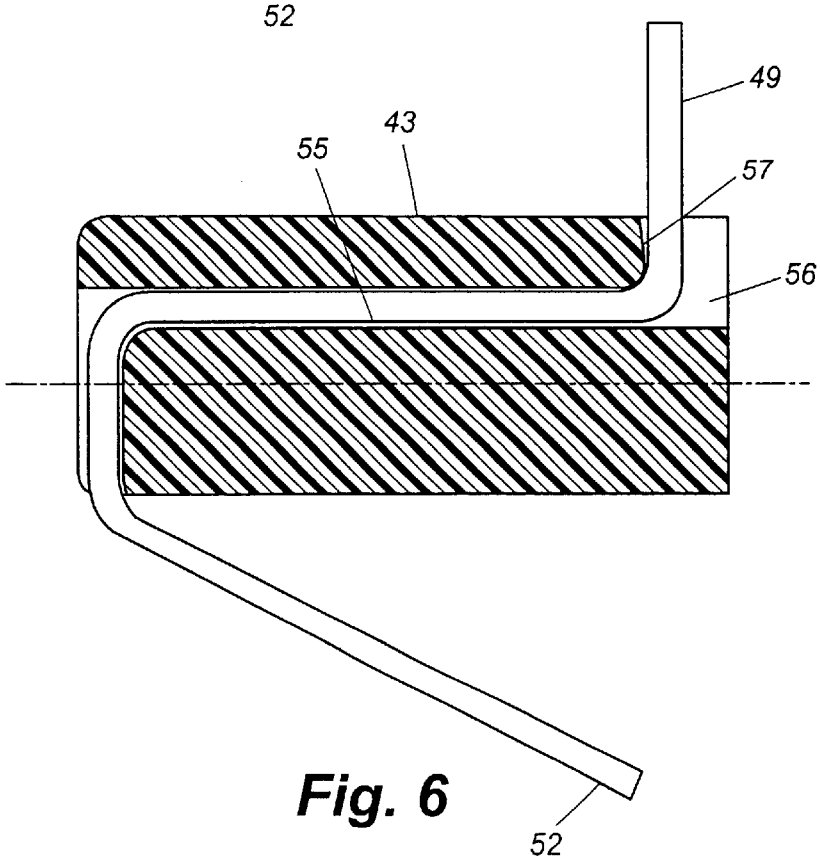
FIG. 6 is a cross-sectional diagrammatic elevation view of the spring block of FIG. 5 illustrating the routing of the upper array of conductors.

FIG. 6 is a cross-sectional diagrammatic view of configuration of slots 56 within body portion 43, and the location of a conductor 49 of the upper array 48 which extends through bore 55, and is bent through 90° at the connection end. FIG. 6 further depicts the position of a conductor 49 as part of the upper array 48 and in its slot 56, and surface 57 is preferably formed with an angle Ø in the same manner as for slot 54.

Figure 7:
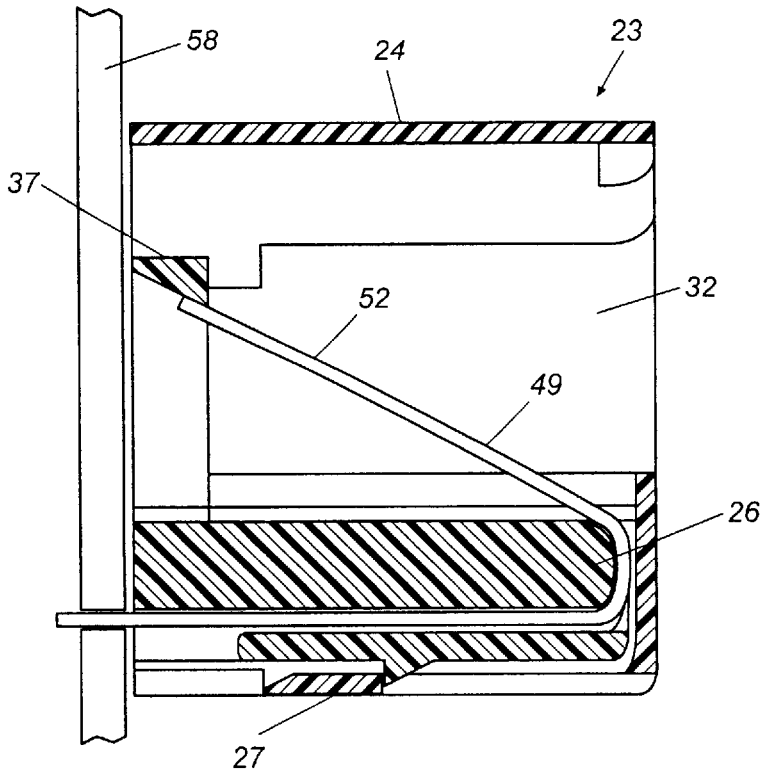
FIG. 7 is a cross-sectional diagrammatic elevation view of the spring block and jack frame of the invention as configured for a vertically oriented PWB.

FIG. 7 is a cross-sectional diagrammatic view in elevation of an assembled connector 23 as mounted on a vertically oriented PWB 58.

Figure 8:
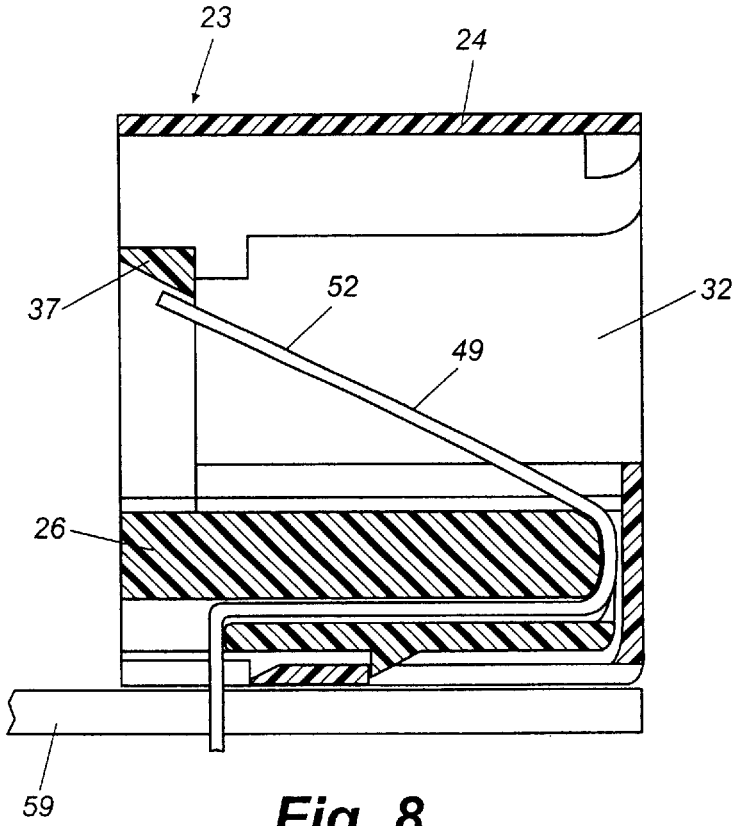
FIG. 8 is a cross-sectional diagrammatic elevation view of the spring block and jack frame as configured for a horizontally oriented PWB.

FIG. 8 is a cross-sectional diagrammatic view in elevation of an assembled connector 23 as mounted on a horizontally oriented PWB 59.

Figure 9:
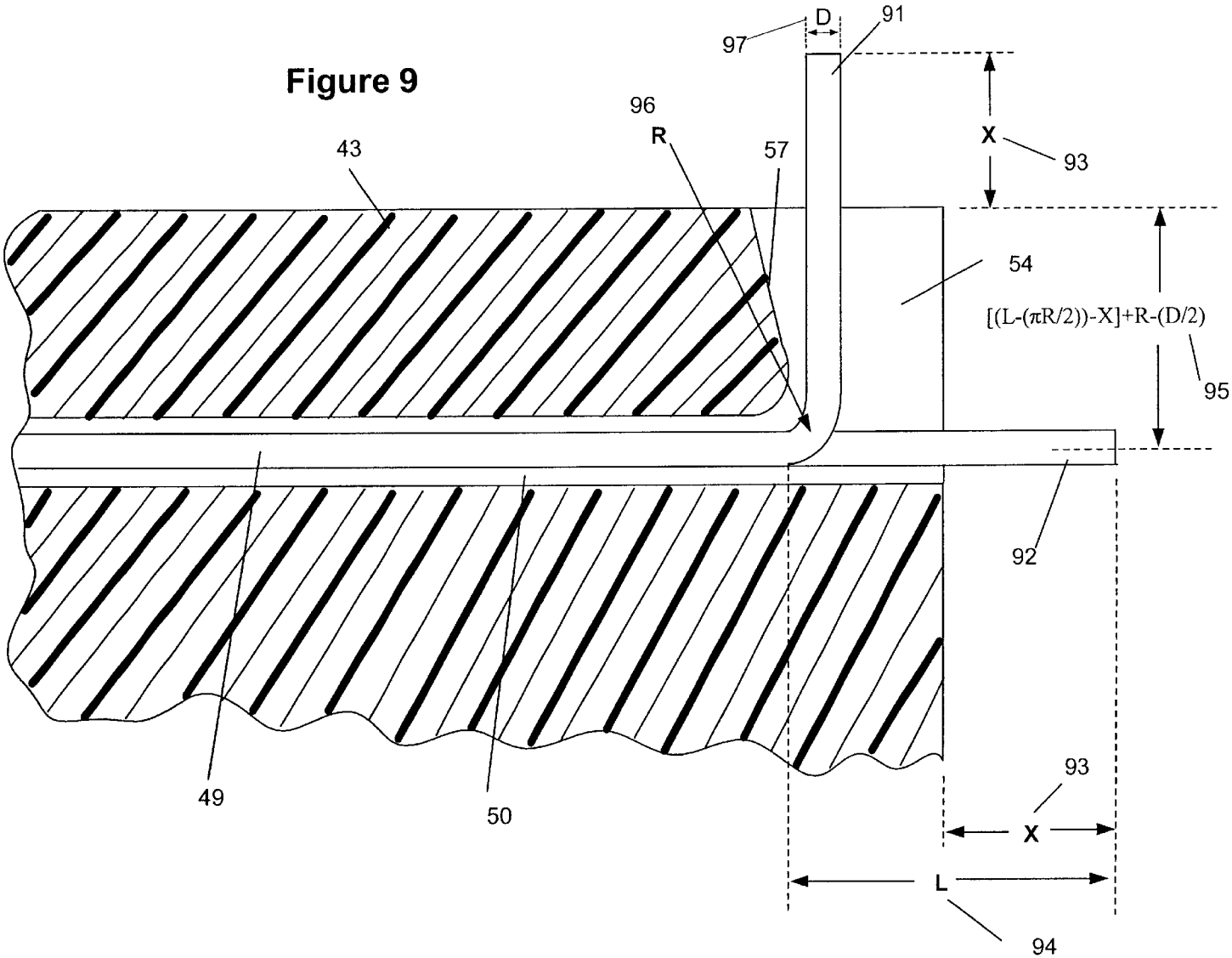
FIG. 9 is a cross-sectional diagrammatic elevation view of the spring block of the present invention showing the slant angle and both configurations for connection with either a vertical or horizontal oriented PWB.

FIG. 9 is a cross-sectional diagrammatic elevation view of the spring block 26 showing the slanted surface 57 and resulting angle and additionally shows vertical 91 and horizontal 92 configurations for connection of the spring block 26 with either a vertically or horizontally oriented PWB. Additionally, it is shown that the length (X) 93 of the conductor 49, having a diameter (D) 97 that extends from the spring block 26 in either the vertical 91 or horizontal 92 orientation is substantially the same or equivalent. In the vertical 91 orientation, the radius of curvature (R) 96 of the conductor 49 is determined by the positioning and configuration of the slanted surface 57. The length (L) 94 of the conductor 49 that is formable may be represented by the formula 95 $[(L-(\pi R/2))-X]+R-(D/2)$. In operation, it is apparent that the conductor 49 extending through the bore 50 may remain straight during application in the horizontal 92 orientation or the conductor 49 may be bent along the slanted surface 57 through 90° +Ø to insure that its natural resilience will cause it to stabilize at 90° during application in the vertical 91 orientation. Accordingly, the conductor 49 is easily arranged into a vertical 91 or horizontal 92 orientation for application to a vertically or horizontally oriented PWB.

It can be appreciated that the principals and features of the invention are applicable to many different connector configurations, which may have more or fewer conductors and a variety of shapes. For example, in one prior art connector, the jack housing and the spring block are an integral unit having, for example, two pair accommodations. The present invention makes it possible to adapt such a connector to mounting on a horizontal or a vertical PWB.

It is to be understood that it will be obvious to those skilled in the art that many modifications and variations may be made to the embodiments of the invention herein shown without substantial departure from the principles and spirit thereof. All such variations and modifications are intended to be included herein as being within the scope of the present invention as set forth in the claims. Further, in the claims, the corresponding structures, materials, acts and equivalents of all means or step-plus-function elements are intended to include any structure, material, or acts for performing the functions in combination with other claimed elements as specifically claimed.

What is claimed is:

1. For use in an electrical connector assembly, a dielectric spring block member comprising a body portion having an upper surface and having a spring contact end, a connector end, and a longitudinal horizontal centerline wherein:

said spring block member has a first array and a second array of passages extending therethrough from the spring contact end to said connector end;

said first and second arrays of passages have first and second arrays of conductors therein;

said first array of passages is positioned such that said first array of conductors therein are vertically spaced from said second array of conductors in said second array of passages;

said first and second array of passages communicating with a first and a second plurality respectively of spaced slots contained within the connector end, each of said slots extending from one of said passages to said upper surface of said spring block member;

each of said slots having an angled inner surface which slopes upward and away from said connector end at an angle of approximately 90° plus an angle Ø relative to the longitudinal horizontal centerline of said spring block member;

said first and second arrays of conductors are positioned within said first and second arrays of passages such that said conductors extend through said connector end of said spring block member;

said passages and said slots communicating therewith are positioned such that said first and second arrays of conductors, within the first and second passages respectively are positionable into either a vertical or horizontal orientation relative to said longitudinal horizontal centerline; and said first and second arrays of conductors extend the same distance beyond said body portion of the spring block member at the connector end thereof regardless of their orientation.

2. A spring block member as claimed in claim 1 wherein:

said first passages are positioned such that said first array of conductors contained therein extend from said first plurality of slots and from the upper surface of said spring block member at an angle of 90° to the horizontal centerline of said spring block member; and said second passages are positioned such that said second array of conductors contained therein extend from said second plurality of slots and from the upper surface of said spring block member at an angle of 90° to the horizontal centerline of said spring block member.

3. A spring block member as claimed in claim 1 wherein:

said first and second arrays of passages are configured such that said first and second arrays of conductors extend beyond said connector end of said spring block member; and in said horizontal orientation, said first array of conductors is positioned in slots which extend lower than slots for second array of conductors, thereby comprising an upper and a lower array of conductors.

4. A spring block member, as claimed in claim 1 wherein:

said first and second arrays of passages are configured such that said first and second arrays of conductors extend beyond said connector end of said spring block member; and in said vertical configuration, said first array of conductors is bent through an angle of approximately 90° plus an angle Ø to the longitudinal horizontal centerline of said spring block member such that said lower first array of conductors in the vertical orientation becomes a front array, and said second array of conductors is bent through an angle of approximately 90° plus an angle Ø to the longitudinal horizontal centerline of said spring block member such that said upper second array of conductors in the horizontal orientation becomes a rear array in the vertical orientation.

5. A spring block member, as claimed in claim 1 wherein:

said first array of conductors has a vertical length extending through and past said connection end of said spring block member when said first array of conductors are positioned into said vertical orientation;

said second array of conductors has a vertical length extending through and past said connection end of said spring block member when said second array of conductors are positioned into said vertical orientation; and said vertical lengths of said first and second arrays of conductors are equivalent in said vertical orientation.

6. A spring block member, as claimed in claim 1 wherein:

said first array of conductors has a horizontal length extending through and past said connection end of said spring block member when said first array of conductors are positioned into said horizontal orientation;

said second array of conductors has a horizontal length extending through and past said connection end of said spring block member when said second array of conductors are positioned into said horizontal orientation; and said horizontal lengths of said first and second arrays of conductors are equivalent in said horizontal orientation.

7. A method for configuring an electrical connector assembly for mounting to a horizontal oriented printed wiring board wherein the connector assembly comprises a dielectric spring block having a longitudinal centerline and having a plurality of first and second vertically spaced conductor containing passages extending through the block from a spring contact end to a connector end thereof and first and second vertically spaced arrays in the passages extending horizontally from the connector end;

bending the conductors in said first array upward and away from the connector end and toward the spring contact end at an angle greater than 90° relative to the centerline; and bending the conductors in said second array upward and away from the connector end and toward the spring contact end at an angle greater than 90° relative to the centerline.

8. The method of claim 7 wherein the angle to which said first array is bent is approximately 90° plus an angle Ø past the vertical relative to the centerline.

9. The method as claimed in claim 7 wherein the angle to which said second array is bent in approximately 90° plus an angle Ø past the vertical relative to the centerline.

10. The method as claimed in claim 7 wherein the angle to which both said first and second arrays are bent is approximately 90° plus an angle Ø past the vertical relative to the centerline.

* * * * *